United States Patent [19]

Lyons

[11] Patent Number: 4,954,938

[45] Date of Patent: Sep. 4, 1990

[54] LIGHT WITH WIDE ANGLE RADIATION PATTERN

[75] Inventor: H. Wayne Lyons, Killingsworth, Conn.

[73] Assignee: Whelen Technologies, Inc., Chester, Conn.

[21] Appl. No.: 312,479

[22] Filed: Feb. 21, 1989

[51] Int. Cl.[5] ..... F21V 7/00; F21V 33/00

[52] U.S. Cl. ..... 362/298; 362/304; 362/346; 362/254

[58] Field of Search ..... 362/297, 298, 304, 346, 362/254

[56] References Cited

U.S. PATENT DOCUMENTS 2,719,967 10/1955 Donley ..... 362/341 X 3,283,142 11/1966 Freeman ..... 362/298

*Primary Examiner*—Allen M. Ostrager

*Attorney, Agent, or Firm*—Chilton, Alix & Van Kirk

[57] ABSTRACT

A warning light having a wide angle radiation pattern and the ability to accept either an incandescent lamp or gaseous discharge tube as the light source is disclosed. The wide angle radiation pattern is, in part, achieved through the use a reflector having three separate surfaces which define parabolas with different axes and a common focal point, two of these parabolic reflector surfaces being spacially separated from one another and extending from the third reflective surface. The light emitter is supported from the third parabolic reflector surface such that the lamp filament or the gaseous discharge tube will extend through the common focal point.

22 Claims, 3 Drawing Sheets

LIGHT WITH WIDE ANGLE RADIATION PATTERN

BACKGROUND OF THE INVENTION

(1) FIELD OF THE INVENTION

The present invention relates to lights and, more particularly, warning lights having a wide angle radiation pattern, particularly in a band lying about a single plane. Accordingly, the general objects of the present invention are to provide novel and improved devices of such character.

(2) DESCRIPTION OF THE PRIOR ART

Warning lights which are employed on emergency vehicles, such as police cars, ambulances, fire trucks, motorcycles and the like, are intended to perform the function of warning of the approach of the vehicle. This requires that the light energy which is produced be intermittent, i.e., be emitted in bursts or pulses, be concentrated in a horizontal plane parallel to the surface over which the vehicle is traveling and be radiated in a wide angle pattern so as to alert traffic approaching from the sides, traffic approaching from the direction in which the vehicle is headed and traffic being overtaken. Such warning lights often comprise a revolving lamp or mirror, but may alternatively comprise a xenon flash tube and cooperating lens and reflector. The prior art warning lights can be relatively expensive to manufacture. An additional drawback of many prior art warning lights is the lack of volumetric efficiency of the light. A further drawback of prior warning lights resides in their inability to interchangeably employ, as the light source, incandescent, i.e., halogen, lamps and gaseous, i.e., xenon, discharge tubes.

A number of improved lights having particular applicability in connection with warning lights on emergency vehicles have recently been introduced. Many such lights employ xenon flash tubes and have found wide popularity. For example, U.S. Pat. No. 4,792,717, which is assigned to the assignee of the present invention, discloses a compact wide-angle warning light. The warning light of U.S. Pat. No. 4,792,717 comprises a unique concave reflector, a lens and a light emitter in the form of an elongated xenon flash tube. The reflector comprises a linear section having side walls which are at least in part parabolic, the linear section being disposed between parabolic dish end sections. The lens is preferably provided with spatially displaced parallel light spreaders for directing the emitted light.

SUMMARY OF THE INVENTION

Briefly stated, the present invention in a preferred form is a light assembly comprising a reflector body, a source of light, and a lens cover which mounts over the reflector body. The reflector body comprises a first parabolic dish-like reflector which forms a surface of revolution about a central axis. A mounting base projects from the first reflector surface for interchangeably mounting a light emitter such as a halogen lamp or a gaseous discharge tube. The central axis extends through the lamp base. A pair of projections or wings are located at equidistantly-spaced diametral positions from the central axis. The wings each define a parabolic reflector surface which has its axis canted in relation to the surface of the first reflector. The lens cover preferably includes a multiplicity of light spreaders, typically optical refracting ribs, which project interiorly from the cover surface. A pair of recesses are formed in the cover interior for mating with outwardly disposed shoulder portions of the wings so as to mount the lens to the reflector body and to angularly fix the orientation of the axes of the spreaders relative to the reflector body. A source of radiation, in the form of a halogen lamp or gas discharge tube positioned in the envelope between the lens cover and the reflector body, produces light which is projected as a generally uni-directional beam, i.e., a beam which is concentrated by a plane, having a wide angle radiation pattern.

The focal distance, i.e., the distance between the vertex and the focal point, of the wing reflector surfaces is greater than the corresponding focal distance of the reflector dish. The focal points of all three cooperating parabolic reflector surfaces are substantially located at a common point on the central axis. The common focal point also falls within the region occupied by the light source. The lamp base preferably comprises a dual socket arrangement for optionally mounting either an incandescent lamp such as a halogen lamp or a gas discharge tube such as a xenon flash tube so that the light source will be located at the common focal point. The lamp base may be a tapered base. The wings take the form of axially extending projections defined between pairs of shoulders which are engagable within the recesses in the side wall of the lens cover. The reflector body may also have an annular transverse shoulder and include a circular recess for receiving a complementary tongue of the lens cover and engaging against the transverse shoulder of the lens cover.

The lens cover preferably comprises a convex shaped frontal panel having a central window. The spreaders on this frontal panel are preferably parallelly oriented with their axes extending in a first direction and the wings are positioned so that a plane defined by the central axis and the angular middle of the wings is orthogonal to the first direction. The optical ribs preferably have an arcuate shaped cross-section and a generally uniform width throughout.

An object of the invention is to provide a new and improved warning light for an emergency vehicle.

Another object of the invention is to provide a new and improved warning light having a wide angle radiation pattern and which is relatively inexpensive to manufacture.

Another object of the invention is to provide a new and improved warning light which is compact while providing a high level of light intensity and a large illuminated region in relation to the physical size of the light.

A further object of the invention is to provide a new and improved warning light which is readily adaptable for installation on new emergency vehicles or retro-fitting on existing emergency vehicles.

A yet further object of the invention is to provide a new and improved warning light of efficient construction which is capable of accepting either a gaseous discharge tube or an incandescent lamp light source.

Other objects and advantages of the invention will become apparent from the drawings and the specification.

DETAILED DESCRIPTION OF THE INVENTION

With reference to the drawings, wherein like numerals represent like parts throughout the several figures, a warning light assembly in accordance with the present invention is designated generally by the numeral 10. The light assembly, upon energization, is capable of producing a radiation pattern which is concentrated about a horizontal plane. The radiation pattern is designed to intersect vehicular traffic approaching from the side and to be strikingly visible. The light assembly has particular applicability in connection with warning lights for emergency vehicles, in particular motorcycles and other police, public safety and fire vehicles. The light assembly 10 will typically be mounted on a vehicle front or rear. The mounting hardware is conventional and is not illustrated.

Figure 10:
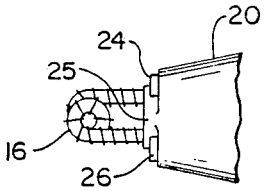
FIG. 10 is an enlarged fragmentary perspective view illustrating a xenon flash tube mounted to the reflector body of FIG. 4.
Figure 11:
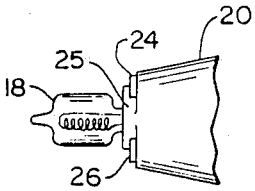
FIG. 11 is an enlarged fragmentary perspective view illustrating a halogen lamp mounted to the reflector body of FIG. 4.

The light assembly 10 comprises a reflector body 12 and a removable lens cover 14 which is adhesively secured to the reflector body. The source of light emission of the warning light may be either a gaseous discharge tube, such as a xenon flash lamp 16 (FIG. 10), or a halogen lamp 18 (FIG. 11). The light assembly 10 is capable of mounting either a gas discharge tube or an incandescent lamp such as a halogen lamp without any additional modifications thereto as will be hereinafter described.

The reflector body 12 is an integral one-piece member which may be molded from plastic or similarly fabricated from some other suitable material. The reflector body comprises a centrally located tapered socket 20 having a generally oval-shaped cross-section at its base. The lamp socket tapers from its base toward an upper terminus which defines a central halogen lamp socket 22 and a bifurcated gas discharge tube receiver. The gas discharge tube receiver comprises a pair of laterally spaced cylindrically-shaped sockets 24 and 26 which receive the ends of the gas discharge tube.. The halogen lamp socket 22 is partially defined by opposing wall portions of sockets 24 and 26 and projecting arcuate retainer flanges 25 and 27. Opposed retainer strips 29 extend axially from the walls of sockets 24 and 26. The spacing between arcuate flanges 25 and 27 and retainer strips 29 is dimensioned so that the halogen lamp base may be closely received and captured by the cooperative structures.

Figure 1:
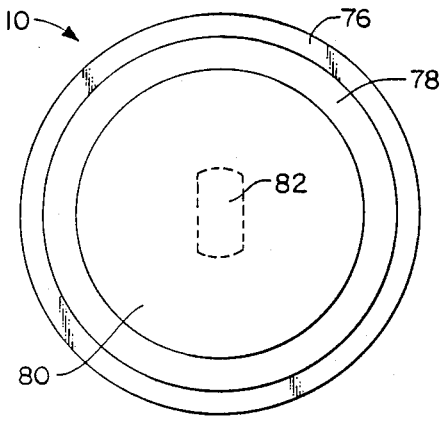
FIG. 1 is a front view of an emergency vehicle warning light in accordance with the present invention.
Figure 2:
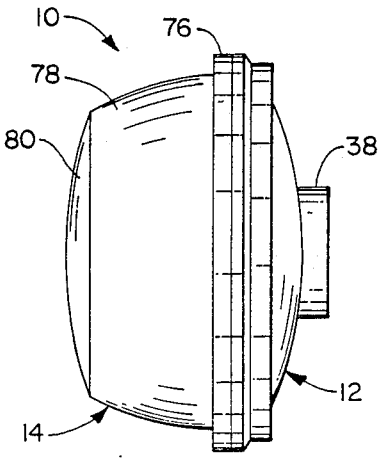
FIG. 2 is a side elevational view of the warning light of FIG. 1.
Figure 3:
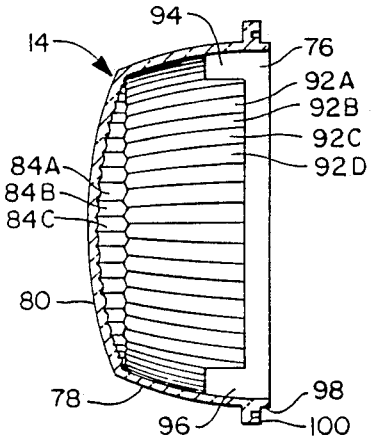
FIG. 3 is a side sectional view of the lens cover of the warning light of FIG. 1.
Figure 4:
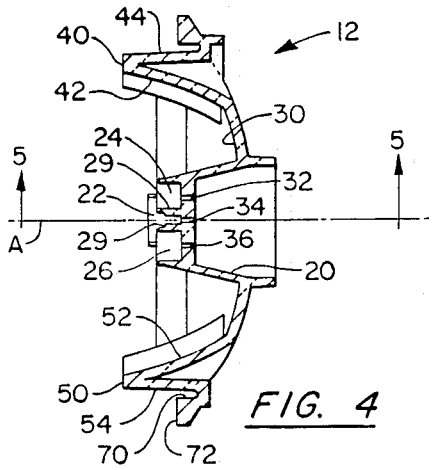
FIG. 4 is a side sectional view of the reflector body of the warning light of FIG. 1.
Figure 5:
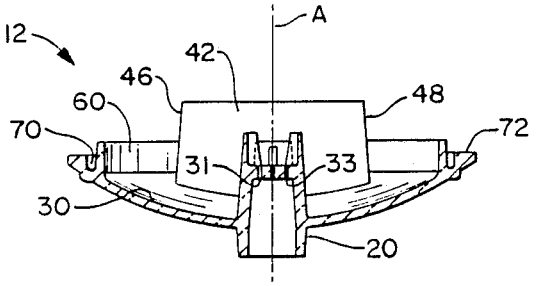
FIG. 5 is a sectional view of the reflector body of FIG. 4 taken along the line 5—5 thereof.
Figure 6:
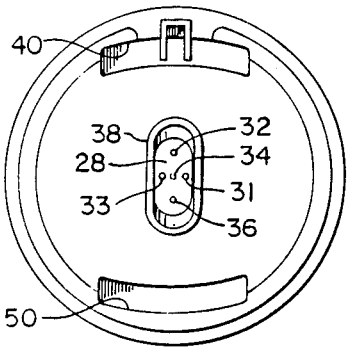
FIG. 6 is a rear view of the warning light of FIG. 1.
Figure 7:
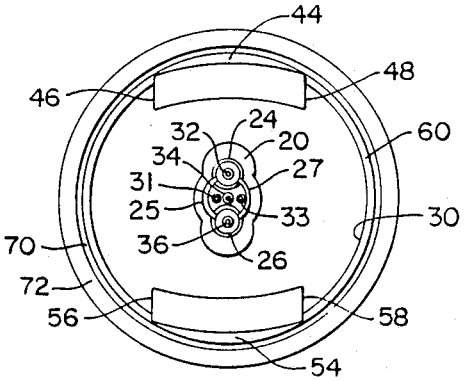
FIG. 7 is a front view of the reflector body of FIG. 1.
Figure 8:
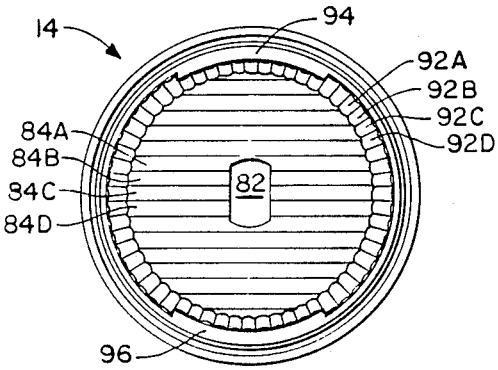
FIG. 8 is an interior view of the lens cover viewed from the right of FIG. 3.

A platform 28 (FIG. 6) forms the bottom engagement structure for the sockets 22, 24 and 26. The platform 28 extends transversely at an intermediate position of the tapered base 20. With additional reference to FIG. 7, apertures 32, 34, and 36 in the platform form openings for the electrical leads for energizing the gas discharge tube. Apertures 31 and 33 form openings for the halogen lamp electrical leads. The rear of the lamp mounting base projects from the rear surface of the reflector body to form an oval shaped housing 38.

Figure 9:
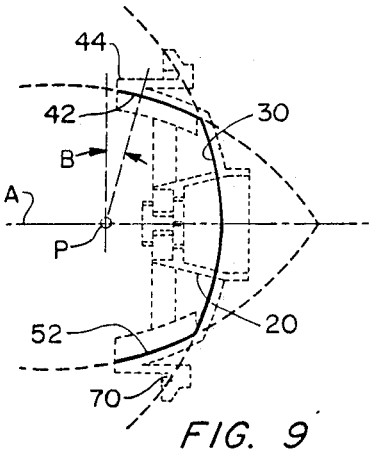
FIG. 9 is a schematic view of the reflector body of FIG. 4 illustrating the geometric relationships of the parabolic reflectors thereof.

The reflector body 12 comprises a parabolic reflector dish 30 which forms a surface of revolution, i.e., a portion of a paraboloid of revolution about a central axis A through the lamp mounting base 20. With reference to FIG. 9, the focal point P of the reflector dish 30 lies on axis A. It will be appreciated that a central portion, i.e., the filament of a mounted halogen lamp or the active portion of a mounted xenon flash tube is located on the focal point P.

A pair of diametrally opposed reflector wings 40 and 50 project outwardly from opposing locations of the parabolic dish 30. The reflector wings 40 and 50 are equidistantly spaced from axis A and, in the disclosed embodiment, subtend an angle of approximately 60°. The reflector wings are substantially identical in shape, form and function. Wing 40 comprises an inner parabolic reflector surface 42 and an outer arcuate key 44 extending between shoulders 46 and 48. The arcuate portion 44 and shoulders 46 and 48 function as a locating and retainer key, as will be further described. Referring to FIG. 9, the axis of the paraboloid of revolution of defined by reflective surface 42 is canted at an angle B to the axis A of the parabolic reflector dish 30. The paraboloid of revolution of reflector surface 42 has a focal length (distance between the focal point and the vertex) which is greater than the corresponding focal length of the paraboloid of revolution of dish 30. The focal point of reflector surface 42 is ideally the same as dish 30, i.e., is point P. Slight variation from the ideal location, for example due to manufacturing tolerances, can be tolerated.

The reflector wing 50, which is the mirror image of wing 40 in the disclosed embodiment, likewise has a parabolic reflector surface 52, arcuate key portion 54 and shoulders 56 and 58, as previously described for reflector wing 40. The focal point of the paraboloid of revolution defined by surface 52 is, in the disclosed embodiment, coincident with that of surface 42, but the surfaces 42 and 52 do not form part of a common parabola. Thus, the reflector of a light in accordance with the invention is defined by three intersecting parabolic reflectors which are designed to have a common focal point. The outer peripheral portion of the parabolic dish 30 intersects an axially extending cylindrical rim 60 which connects with the reflector wings 40 and 50. The rim 60 and wing key portions 44 and 54 function to define an inner wall of a circular recess 70. An outer annular transverse lip 72 partially defines the recess 70. It should be appreciated that a highly reflective metallic coating will typically be applied to the reflector surfaces 30, 42 and 52, and also to the mounting base 20 and rim 60, to provide a "metallized" reflector having efficient optical reflecting qualities.

The lens cover 14 is a one-piece molded plastic member which may be manufactured from General Electric "Lexan" material or other material with suitable optical properties. The lens cover may be tinted with blue, amber or red pigments as desired. The lens cover has a generally cup-like shape which includes a mounting base 76, a rounded tapered side panel 78, and a convex front panel 80. The exterior surface of the lens cover 14 is generally symmetric about a central axis, which upon mounting to the reflector body, coincides with axis A. The convex front panel 80 of the disclosed embodiment includes a central oblong window 82. The window 82, when present, has a substantially uniform thickness to allow radiation to pass essentially directionally unimpeded through the central lens cover window.

The interior surface of the panel 80 is, other than in the area of a window 82, defined by a multiplicity of optical spreader bars or ribs 84A, 84B, 84C . . . which protrude inwardly. The optical spreader ribs each have an axis and a generally arcuate cross-section of generally uniform dimension thereacross. While the optical spreader ribs can be arranged in any manner to achieve the desired light emission pattern, including being arranged in groups, in the preferred embodiment, the spreaders are all generally disposed in parallel side-by-side relationship and have substantially the same width. The optical spreader ribs are integral refractor structures which, when parallelly oriented, produce a generally uni-planar radiation pattern at the light assembly exterior.

The side panel 78, in the disclosed embodiment, likewise includes a multiplicity of adjacent optical spreader ribs 92A, 92B, 92C, 92D . . . protruding from the interior surface thereof. The optical spreader ribs 92A, 92B, 92C . . . have an arcuate shaped section and are dimensioned to slightly taper from proximate the cover base 76, where the side panel diameter is greater, to the outer terminus where the ribs 92A, 92B, 92C . . . intersect with optical spreader ribs 84A, 84B, 84C . . . it will be appreciated that the optical spreader ribs function as refractor elements in cooperation with the reflector surfaces to redirect light generated by a source to produce the desired radiation pattern.

A pair of diametrically opposed substantially identical recesses 94 and 96 are formed in the interior side panel 78 of the lens cover. The recesses 94 and 96 have an arcuate contour complementary with that of wing portions 44 and 54, respectively, and are generally rectangular in shape. The recesses 94 and 96 are dimensioned to mate with a respective key portion 44 and 54 and corresponding shoulders of the reflector wings. The lens cover may thus be mounted on the reflector body and self-aligned by inserting the reflector wings 40 and 50 into the corresponding recesses 94 and 96. In this manner, the proper angular orientation of the optical spreader ribs may be efficiently achieved.

The lens cover base 76 also includes an axially projecting annular tongue 98, which is received in the reflector recess 70, and a cooperating transverse shoulder 100, which engages the circular lip 72 of the reflector body. The lens cover may thus be efficiently mounted to the reflector body and coupled therewith to provide the correct optical directional orientation of the lens cover.

Figure 12:
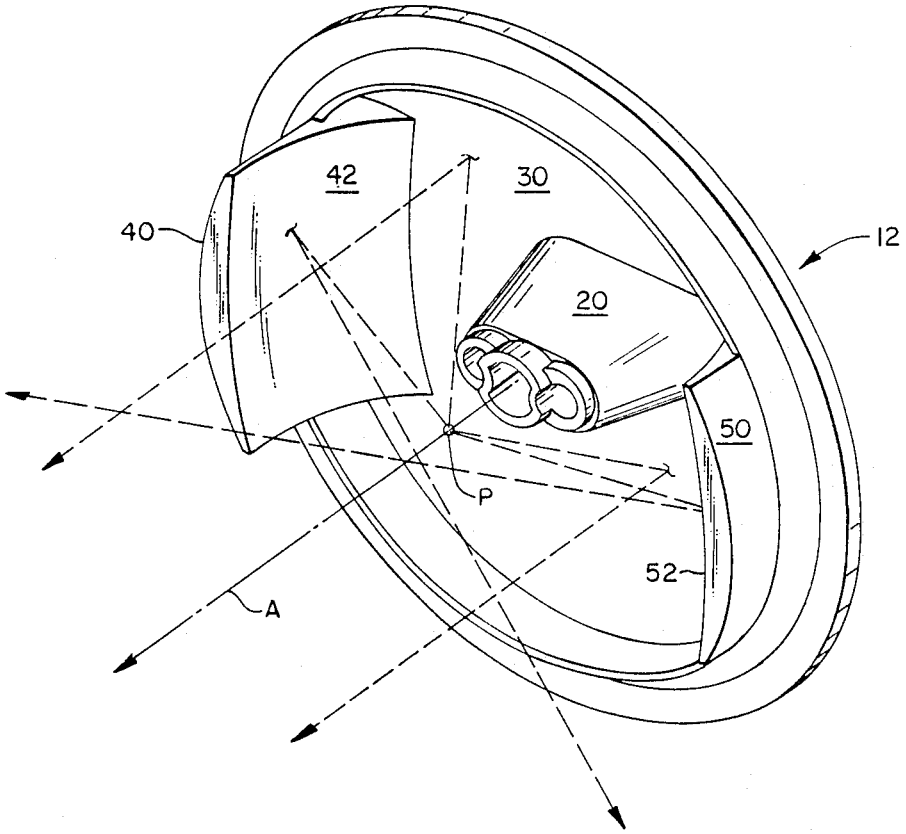
FIG. 12 is a perspective view of the reflector of FIGS. 4–7 with the paths of light emitted by a light source located at the focal point being shown schematically.

FIG. 12 schematically depicts the operation of a light in accordance with the invention by showing, via broken lines, the paths of light incident on the three reflective surfaces 30, 42 and 52. When this light is caused to pass through the lens, any "hot spots" will be substantially eliminated and a band of light about a plane and having a radiation pattern which approaches 180° will result In one embodiment of a warning light assembly 10 in accordance with the present invention, the distance from the central vertex of the parabolic dish 30 to the focal point P is 1.5 inches. The axes of the reflector surfaces 42 and 52 of the wings were canted at an angle B of 15° relative to a line transverse to the axis A of the parabolic dish 30. The distance from the common focal point of the wing reflector surfaces to the respective vertices was 1.68 inches. Each of the three focal points (parabolic surfaces 30, 42, 52) has a substantially common locus which is at a central location of a strobe tube 16 or at the filament of a halogen lamp 18 mounted in its respective appropriate socket or sockets. There are sixty optical spreader ribs 92A, 92B, 92C . . . equidistantly spaced about the side panel. The optical refractor ribs 84A, 84B, 84C . . . have a radius of curvature of approximately 0.187 inches. The radius of curvature of the front panel 80 is approximately five inches, and the lens cover 14 projects axially from the reflector body 12 approximately 1.8 inches.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A light assembly comprising:

body means for forming an integral rigid base structure, said body means comprising:

first reflector means for defining a dish-like parabolic reflector surface which is symmetrical about a central axis, said first reflector means defined parabolic surface having a focal point and a vertex which lie on said central axis;

mounting means projecting from said first reflector means parabolic surface for mounting a light emitter, sad central axis extending through said mounting means; and first and second wing means extending from said first reflector means for forming a pair of generally axially projecting wing-like extensions, said first and second wing means being located at equidistantly spaced diametral positions relative to said central axis, said wing means each defining a parabolic reflector surface, the paraboloids of revolution which include said wing means reflector surfaces each having a vertex and a focal point which define an axis, said wing means reflector surface paraboloidal axes being angularly oriented relative to a plane in which said central axis lies, said plane being substantially equidistantly spaced from said first and second wing means, the focal points of said wing means paraboloids of revolution being substantially coincident with said first reflector means focal point; and light emitter means supported by said mounting means for emitting light upon energization thereof, said light emitter means being at least in part positioned at said focal point.

2. The light assembly of claim 1 wherein the distance between the vertices and the focal points of said first and second wing reflector surfaces is greater than the focal distance between the focal point and the vertex of said first reflector surface.

3. The light assembly of claim 2 wherein said mounting means comprises dual socket means for mounting an incandescent lamp or a gaseous discharge tube.

4. The light assembly of claim 3 further comprising:
lens means for cooperating with said body means to define an envelope therebetween.

5. The light assembly of claim 4 wherein said lens means comprises:
a cover having a multiplicity of optical refracting ribs projecting interiorly therefrom; and
recess means for defining a pair of recesses for mating with said first and second wing means so as to axially mount the lens means to said body means and fix the angular orientation of said ribs relative to said body means.

6. The light assembly of claim 1 wherein said mounting means comprises dual socket means for mounting an incandescent lamp or a gaseous discharge tube.

7. The light assembly of claim 6 further comprising:
lens means for cooperating with said body means to define an envelope therebetween.

8. The light assembly of claim 7 wherein said lens means comprises:
a cover having a multiplicity of optical refracting ribs projecting interiorly therefrom; and
recess means for defining a pair of recesses for mating with said first and second wing means so as to axially mount the lens means to said body means and fix the angular orientation of said ribs relative to said body means.

9. The light assembly of claim 2 further comprising:
lens means for cooperating with said body means to define an envelope therebetween.

10. The light assembly of claim 9 wherein said lens means comprises:
a cover having a multiplicity of optical refracting ribs projecting interiorly therefrom; and
recess means for defining a pair of recesses for mating with said first and second wing means so as to axially mount the lens means to said body means and fix the angular orientation of sad ribs relative 11. The light assembly of claim 1 wherein said mounting means comprises a tapered base having a central socket adapted for mounting an incandescent lamp and a pair of laterally spaced sockets adapted for mounting opposing ends of a gas discharge tube.

12. The light assembly of claim 1 further comprising:
lens means for cooperating with said body means to define an envelope therebetween.

13. The light assembly of claim 12 wherein said lens means comprises:
a cover having a multiplicity of optical refracting ribs projecting interiorly therefrom; and
recess means for defining a pair of recesses for mating with said first and second wing means so as to axially mount the lens means to said body means and fix the angular orientation of said ribs relative to said body means.

14. The light assembly of claim 13 wherein said wing means each comprise a structure having a pair of shoulders which are engagable with said recess means.

15. The light assembly of claim 13 wherein said body means further comprises lens means cover receiving means, said cover receiving means having an annular first transverse shoulder and means defining an annular recess, and wherein said lens means further comprises coupling means receivable in said annular recess and a second transverse shoulder which is engagable against said first transverse shoulder.

16. The light assembly of claim 12, wherein said lens means has a cup-like shape comprising a front panel and a continuous tapered side panel, light refractor ribs projecting inwardly from said front and side panels.

17. The light assembly of claim 12 wherein said lens means comprises a convex shaped frontal panel, said frontal panel having a plurality of parallel refractor ribs on the inwardly disposed surface thereof.

18. The light assembly of claim 17 wherein the frontal panel ribs are oriented to extend in a first direction when the lens means is mounted to said body means, the angular midpoints of said first and second wing means and said central axis defining a plane which is orthogonal to said first direction 19. The light assembly of claim 18 wherein said frontal panel ribs have an arcuate shaped cross-section and a generally uniform width.

20. The light assembly of claim 19 wherein said lens means has a cup-like shape comprising a front panel and a continuous tapered side panel, light refractor ribs projecting inwardly from said front and side panels.

21. The light assembly of claim 20 wherein said mounting means comprises a tapered base having a central socket adapted for mounting an incandescent lamp and a pair of laterally spaced sockets adapted for mounting opposing ends of a gas discharge tube.

22. The light assembly of claim 21 wherein the distance between the vertices and the focal points of said first and second wing reflector surfaces is greater than the focal distance between the focal point and the vertex of said first reflector surface.

* * * * *

UNITED STATES PATENT AND TRADEMARK OFFICE

CERTIFICATE OF CORRECTION

PATENT NO. : 4,954,938

DATED : September 4, 1990

INVENTOR(S) : H. Wayne Lyons

It is certified that error appears in the above-identified patent and that said Letters Patent is hereby corrected as shown below:

Column 7, line 43 of claim 10, substitute -- said -- for "sad".

Column 7, line 43 of claim 10, insert -- to said body means -- after "relative".

Signed and Sealed this

Twenty-eighth Day of July, 1992

*Attest:*

DOUGLAS B. COMER

*Attesting Officer*

*Acting Commissioner of Patents and Trademarks*